US005899455A

United States Patent [19]

Crompton

[11] Patent Number: 5,899,455

[45] Date of Patent: May 4, 1999

[54] AMUSEMENT MACHINE

[75] Inventor: Gordon Crompton, Kent, United Kingdom

[73] Assignee: Cromptons Leisure Machines Limited, Kent, United Kingdom

[21] Appl. No.: 08/827,053

[22] Filed: Mar. 25, 1997

[30] Foreign Application Priority Data

Apr. 2, 1996 [GB] United Kingdom ..... 9606916

[51] Int. Cl.[6] ..... A63F 7/02

[52] U.S. Cl. ..... 273/138.01; 273/138.3

[58] Field of Search ..... 273/138.3, 138.4, 273/138.5, 369, 371, 121 B

[56] References Cited

U.S. PATENT DOCUMENTS

| | | | |
|---|---|---|---|
| 1,277,470 | 9/1918 | Paupa et al. | 273/138.3 |
| 5,131,655 | 7/1992 | Ugawa | 273/121 B |
| 5,507,490 | 4/1996 | Hagiwara | 273/138.3 |
| 5,697,611 | 12/1997 | Kelly et al. | 273/138.3 |
| 5,713,572 | 2/1998 | Hagiwara | 273/138.3 |
| 5,752,699 | 5/1998 | Crompton et al. | 273/138.3 |

FOREIGN PATENT DOCUMENTS

| | | |
|---|---|---|
| 1091254 | 10/1966 | United Kingdom . |
| 2124913 | 2/1984 | United Kingdom . |
| 2272383 | 5/1994 | United Kingdom . |
| 1087361 | 7/1996 | United Kingdom . |

*Primary Examiner*—William M. Pierce
*Attorney, Agent, or Firm*—McDermott, Will & Emery

[57] ABSTRACT

An amusement machine comprises a passage (3) having an entry and an exit and defining a plurality of routes through which playing pieces can be caused to pass by a user of the machine. A hopper (8) for playing pieces is positioned between the entry and the exit of the passage and adapted to receive and temporarily hold playing pieces which pass through at least one of the plurality of routes. A movable barrier (14) is arranged between the entry of the passage and the hopper and, depending on its position, permits playing pieces to enter the hopper, or prevents playing pieces from entering the hopper and diverts them to a different route which by-passes the hopper. A counter determines the quantity of playing pieces in the hopper. A gate (9) is cooperable with the hopper and the counter and, when a predetermined quantity of playing pieces is held in the hopper, is actuated to release playing pieces from the hopper, whereby the released playing pieces can pass to the exit of the passage.

5 Claims, 3 Drawing Sheets

AMUSEMENT MACHINE

BACKGROUND OF THE INVENTION

1. Field of the Invention

This invention relates to an amusement machine. More specifically, the present invention relates to amusement.

Machines of the type to which the invention may apply employ a plurality of playing pieces, particularly small playing pieces such as coins or balls. The invention is particularly adapted for use with coin pusher amusement machines, although it should be appreciated that it is not restricted to such machines.

2. Description of the Related Art

Coin pusher amusement machines are illustrated, for example in GB-A-2 124 913 and GB-A-2 272 383. Such machines generally include a horizontal playfield, on which a large number of coins is distributed. In the context of this specification, the term "coins" should be understood as including any similar discs or tokens or the like. The pattern of coins on the playfield is periodically disturbed by a coin pusher, which may be in the form of a movable stage which periodically sweeps across part of the playfield surface. Coins are pushed towards an edge of the playfield and some may be pushed over the edge into a "win chute". From this, they pass into a receptacle and may be recovered by the user of the machine. The user is able to introduce additional coins into the machine, which may pass onto the playfield surface directly or via an upper surface of the coin pusher. The object of the user of the machine is to insert such additional coins with the hope that a larger number of coins will be pushed over the edge into the win chute.

SUMMARY OF THE INVENTION

An object of the present invention is to provide an additional feature of interest which can be used with a coin pusher amusement machine, or which can exist independently as part of an amusement machine in its own right.

The invention provides an amusement machine comprising a passage having an entry and an exit and defining a plurality of routes through which playing pieces can be caused to pass by a user of the machine; holding means for playing pieces between the entry and the exit of the passage and adapted to receive and temporarily hold playing pieces which pass through at least one of said plurality of routes; a movable barrier between the entry of the passage and the holding means which, depending on its position, is adapted to permit playing pieces to enter the holding means, or to prevent playing pieces from entering the holding means and divert them to a different route which by-passes the holding means; measuring means for determining the quantity of playing pieces in the holding means; and release means cooperable with said holding means and said measuring means and, when a predetermined quantity of playing pieces is held in said holding means, adapted to release playing pieces from said holding means, whereby said released playing pieces can pass to the exit of the passage.

In a preferred embodiment of the invention, the playing pieces are coins. The machine is preferably part of a coin pusher amusement machine, and the exit of the passage is adjacent the playfield or moving stage of the coin pusher. Coins are inserted by a user of the machine into the passage, and pass through the passage to the coin pusher, some of the coins being retained in the holding means. Such retained coins are eventually released by the holding means to create a "splash" of coins on the coin pusher.

The barrier may be movable in regular reciprocal manner, or may move at random. Selection of playing pieces which enter the holding means may therefore be at random, or may involve some element of skill by the user of the machine, for example by timing the entry of playing pieces according to the position of the movable barrier.

BRIEF DESCRIPTION OF THE DRAWINGS

A preferred embodiment of the invention is now described with reference to the accompanying drawings, in which.

DETAILED DESCRIPTION OF THE PREFERRED EMBODIMENTS

Figure 1:
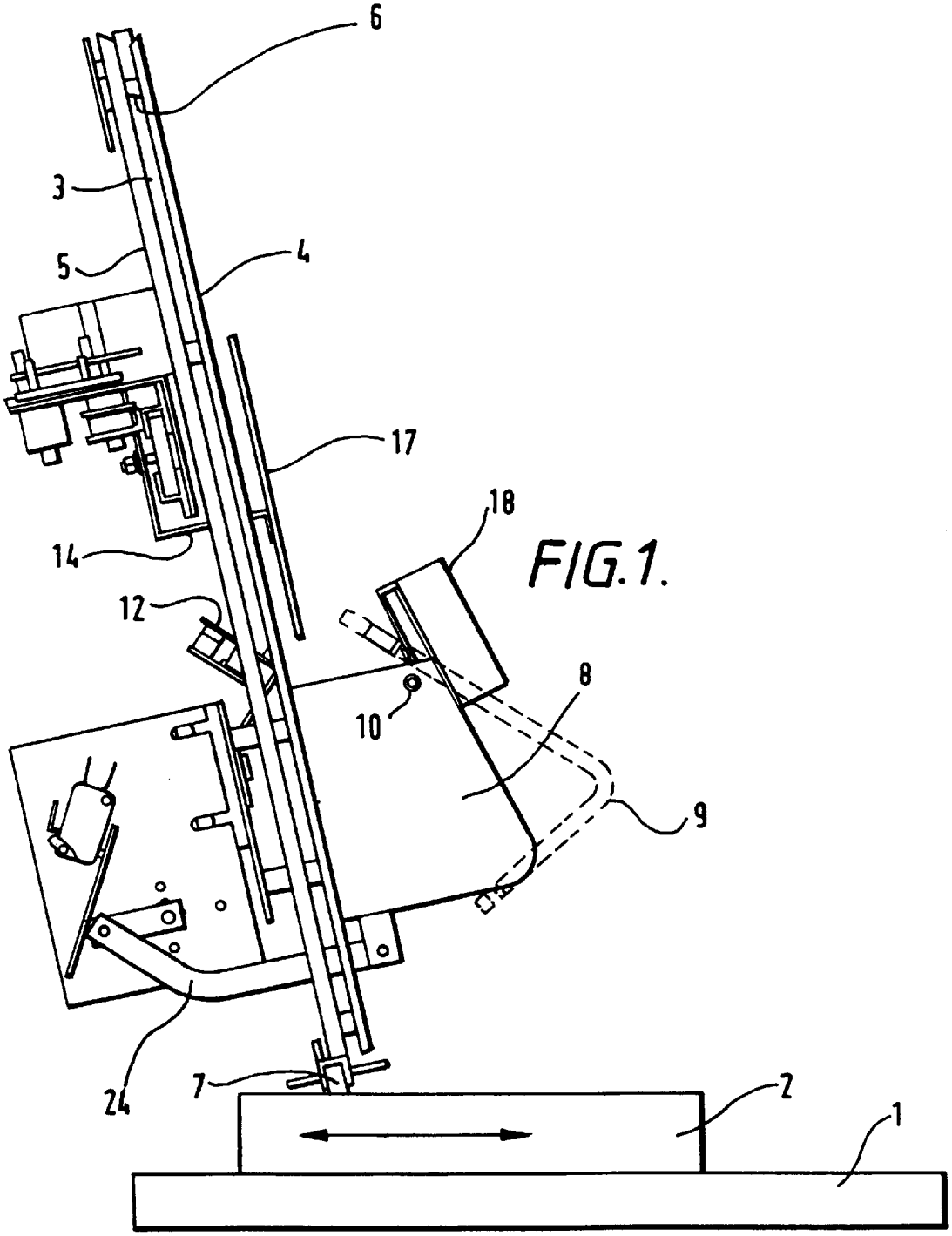
FIG. 1 is a diagrammatic side view of part of an amusement machine.
Figure 2:
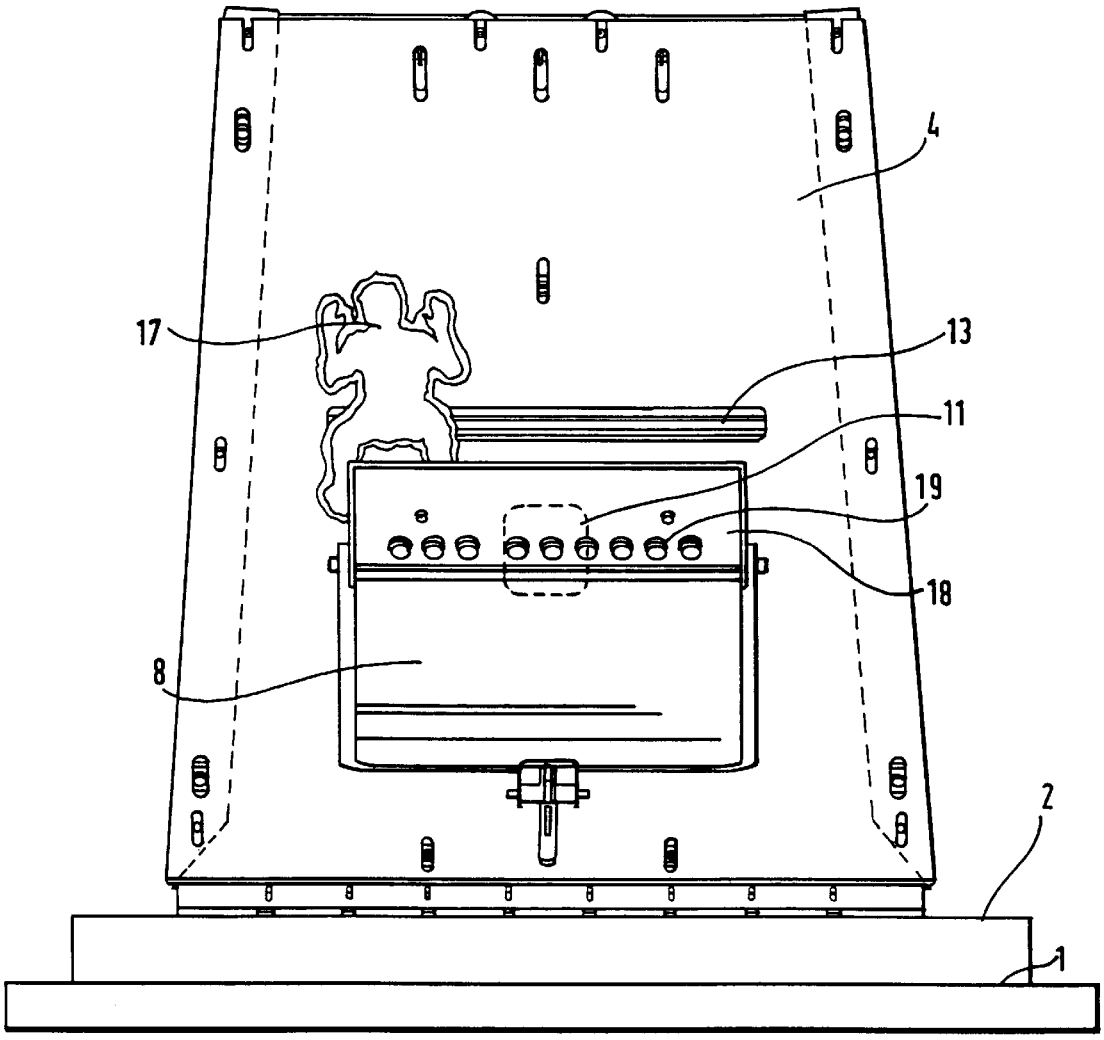
FIG. 2 is a diagrammatic front view of the amusement machine of FIG. 1.
Figure 3:
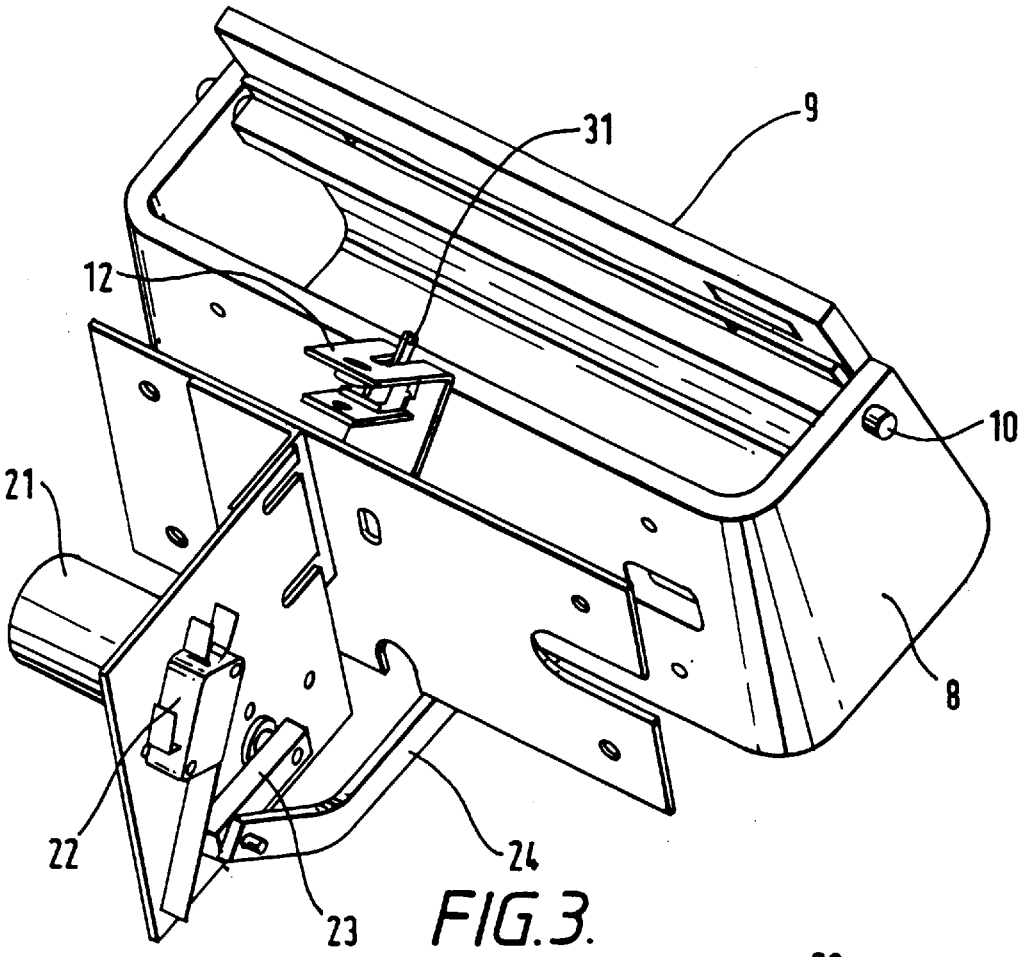
FIG. 3 is a partial perspective view of a hopper and release mechanism, which forms part of the machine.
Figure 4:
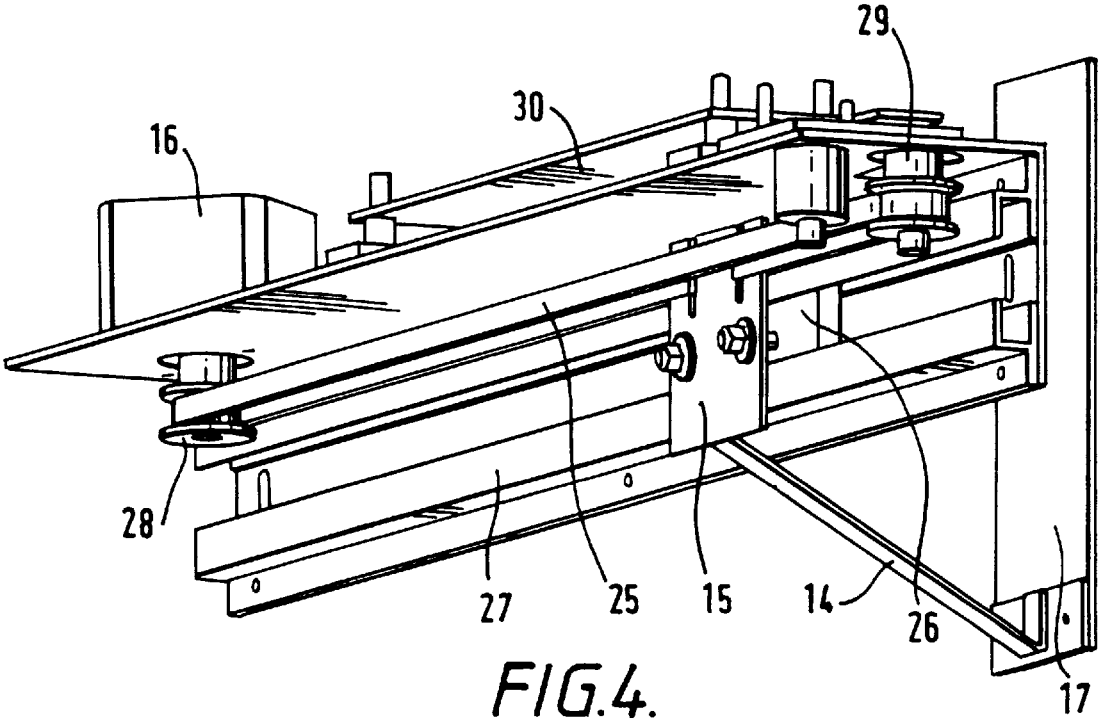
FIG. 4 is a partial perspective view of a linear slide unit forming another part of the machine.

The machine includes a playfield 1 and pusher box 2 as in a conventional coin pusher machine. The pusher box reciprocates across the surface of the playfield. Coins are distributed on the surface of the playfield and on the upper surface of the pusher box. A coin passage 3 is defined between a front sheet 4 and a back sheet 5 of transparent plastics material such as perspex. The gap between the front sheet and back sheet is slightly greater than the thickness of coins to be used. The front sheet and back sheet are held in position relative to each other by a plurality of pins 6 arranged in a pattern on the sheets. Coins are inserted into the machine by a player, and drop through the passage 3, bouncing off the pins 6 in a random manner. Coins which pass through the passage 3 exit at the lower end onto the upper surface of the pusher box 2. A sweeping contact 7 at the lower end of the back sheet 5 sweeps coins across the top surface of the pusher box 2 and some fall over the edge of the pusher box onto the playfield 1. In conventional manner, some coins on the playfield 1 are swept over the edge into a win chute by the reciprocating motion of the pusher box 2.

A coin hopper 8 is positioned on the front surface of the front sheet 4 slightly above the lower end. The top of the hopper 8 is open, and the front and bottom surface is formed as a gate 9 mounted on a pivot 10 so as to be movable between a normal closed positioned and an open position (shown by broken lines in FIG. 1). Movement of the gate 9 is effected by a motor 21 operating through a limit switch 22, crank 23 and actuator arm 24.

An aperture 11 is cut in the front sheet 4 at about the same level as the top of the hopper 8. Adjacent the aperture 11 is a sloping diverter surface passing downwardly from the front of the back sheet 5 to the rear of the front sheet 4 in the vicinity of the aperture 11. Depending on the pattern of the pins 6, some coins inserted into the passage 3 at the top will fall down until they strike the diverter surface 12, whereupon they will be diverted through the aperture 11 and into the hopper 8. Other coins inserted into the top of the passage 3 will fall to either side of the diverter surface 12, and thus bypass the hopper.

A horizontal slot 13 is provided in the front sheet 4 a short distance above the aperture 11, and a corresponding horizontal slot is provided in the back sheet 5 at the same level. An arm 14 passes through both horizontal slots and is mounted on a support bracket 15 driven by a stepper motor 16 on the rear surface of the back sheet 5, so that the arm 14 moves back and forth along the horizontal slots. The support bracket 15 is mounted on a timing belt 25, and connected to a slide block 26 which slides in a slide channel 27. The timing belt is held between a timing pulley 28 and a tensioning arm with timing pulley 29. A control PCB with integral limit switch is provided to control the stepper motor 16. A graphic FIG. 17 is mounted on the front end of the arm 14 which protrudes through the front sheet 4. The back and forth motion of the arm 14 may be at random or a regular reciprocal motion, under appropriate control of the stepper motor 16. When the arm 14 is above the aperture 11, it forms a barrier to coins, so that coins, which would otherwise strike the diverter surface 12 and pass into the hopper 8, instead are caused by the arm 14 to pass to one side or the other of the diverter surface 12. When the arm 14 is not above the aperture 11, then coins can fall onto the diverter surface 12 and thus pass into the hopper 8.

Incorporated in the diverter surface 12 is a coin sensor 31, which may for example be an optical sensor or a microswitch. The sensor includes a counter which counts the coins as they pass into the hopper 8. The number of coins at any time in the hopper 8 is indicated by an LED display 18 on the front of the hopper. The display takes the form of a line of individual LED's 19 which progressively light up as coins are counted into the hopper.

The gate 9 of the hopper, which is normally in the closed position, is actuated by the actuator arm 24 connected to the motor 21 on the rear surface of the back sheet 5. This release mechanism cooperates with the gate 9 and the coin counter under microprocessor control, for example on a printed circuit board. When a predetermined number of coins has entered the hopper 8, as determined by the coin counter, the release mechanism is actuated to open the gate 9. The coins in the hopper are then suddenly released to form a splash of coins on the upper surface of the pusher box 2. This considerably increases the chances of coins being pushed from the top of the pusher box to the playfield and over the edge of the playfield into the win chute. The release mechanism is then actuated to close the gate 9 and the coin counter and LED display are reset to zero. The position of the pusher box 2 is sensed to allow the hopper to open only when the pusher box is in the fully forward position, so that the splash of coins is onto the top surface of the pusher box.

The features of this invention as described above provide an added attraction to a coin pusher amusement machine. The user can attempt to exercise some degree of skill in timing the entry of coins with the position of the graphic FIG. 17, so that the coins are diverted into the hopper 8. The front surface of the hopper is transparent so the build up of coins in the hopper is in full view of the player. The LED display 18 provides an additional indication to the player when the hopper is nearly full. The player is then encouraged to insert further coins so as to gain the benefit of the splash of coins when the hopper opens.

I claim:

1. An amusement machine comprising:

playing pieces;

a passage through which playing pieces can fall, said passage having an entry and an exit, said entry being located above said exit;

a plurality of routes defined within said passage through which said playing pieces can pass;

holding means for said playing pieces which is disposed between the entry and the exit of the passage for receiving and temporarily holding said playing pieces which pass through at least one of said plurality of routes;

a movable barrier between the entry of the passage and the holding means which, depending on its position, is adapted to permit playing pieces to enter the holding means, or to prevent playing pieces from entering the holding means and to divert them to a route which by-passes the holding means;

measuring means for determining the quantity of playing pieces in the holding means;

release means cooperable with said holding means and said measuring means for, when a predetermined quantity of playing pieces is held in said holding means, releasing the playing pieces from said holding means, whereby said released playing pieces can pass to the exit of the passage;

an essentially horizontal playing field on which playing pieces can be distributed; and a movable member adapted to periodically sweep across a part of the playing field and to push playing pieces lying on said playing field thereacross.

2. An amusement machine according to claim 1, in which the playing pieces are coins or coin-like tokens.

3. An amusement machine comprising:

playing pieces;

a passage having an entry and an exit and defining a plurality of routes through which said playing pieces can be caused to pass by a user of the machine;

holding means for said playing pieces between the entry and the exit of the passage and adapted to receive and temporarily hold said playing pieces which pass through at least one of said plurality of routes;

a movable barrier between the entry of the passage and the holding means which, depending on its position, is adapted to permit playing pieces to enter the holding means, or to prevent playing pieces from entering the holding means and divert them to a different route which by-passes the holding means;

measuring means for determining the quantity of playing pieces in the holding means; and release means cooperable with said holding means and said measuring means for, when a predetermined quantity of playing pieces is held in said holding means, releasing the playing pieces from said holding means, whereby said released playing pieces can pass to the exit of the passage in which the, playing pieces are coins or coinlike tokens; and which further comprises a coin push means having a movable stage or playing field; the exit of the passage being located adjacent a playfield or a moving stage.

4. An amusement machine comprising:

playing pieces;

a passage having an entry and an exit and defining a plurality of routes through which said playing pieces can be caused to pass by a user of the machine;

holding means for said playing pieces between the entry and the exit of the passage and adapted to receive and temporarily hold said playing pieces which pass through at least one of said plurality of routes;

a movable barrier between the entry of the passage and the holding means which, depending on its position, is adapted to permit playing pieces to enter the holding means, or to prevent playing pieces from entering the holding means and divert them to a different route which by-passes the holding means;

measuring means for determining the quantity of playing pieces in the holding means; and release means cooperable with said holding means and said measuring means for, when a predetermined quantity of playing pieces is held in said holding means, releasing the playing pieces from said holding means, whereby said released playing pieces can pass to the exit of the passage wherein said passage accepts playing pieces in the form of coins which are insertable by a user of the machine into said passage, and able to pass through the passage to a coin pusher, said holding means retaining coins therein and releasing coins onto the coin pusher after a predetermined number of coins has been retained therein.

5. An amusement machine comprising:

playing pieces;

a passage through which playing pieces can fall, said passage having an entry and an exit, said entry being located above said exit;

a plurality of routes defined within said passage through which said playing pieces can pass;

holding means for said playing pieces which is disposed between the entry and the exit of the passage for receiving and temporarily holding said playing pieces which pass through at least one of said plurality of routes;

a movable barrier between the entry of the passage and the holding means which, depending on its position, is adapted to permit playing pieces to enter the holding means, or to prevent playing pieces from entering the holding means and to divert them to a route which by-passes the holding means;

measuring means for determining the quantity of playing pieces in the holding means; and release means cooperable with said holding means and said measuring means for, when a predetermined quantity of playing pieces is held in said holding means, releasing the playing pieces from said holding means, whereby said released playing pieces can pass to the exit of the passage, wherein said movable barrier is operatively connected with a motor and adapted to move horizontally from side to side.

* * * * *